US010801807B2

(12) United States Patent
DeSomma et al.

(10) Patent No.: US 10,801,807 B2
(45) Date of Patent: Oct. 13, 2020

(54) GAS BLOCK WITH QUICK RELEASE SLING ATTACHMENT

(71) Applicant: Patriot Ordnance Factory, Inc., Phoenix, AZ (US)

(72) Inventors: Frank L. DeSomma, Glendale, AZ (US); Brandon Klar, Mesa, AZ (US)

(73) Assignee: Patriot Ordnance Factory, Inc., Phoenix, AZ (US)

( * ) Notice: Subject to any disclaimer, the term of this patent is extended or adjusted under 35 U.S.C. 154(b) by 0 days.

(21) Appl. No.: 16/032,940

(22) Filed: Jul. 11, 2018

(65) Prior Publication Data

US 2019/0003791 A1 Jan. 3, 2019

Related U.S. Application Data

(63) Continuation of application No. 15/250,218, filed on Aug. 29, 2016, now Pat. No. 10,036,601, which is a continuation of application No. 14/527,698, filed on Oct. 29, 2014, now Pat. No. 9,429,375.

(60) Provisional application No. 61/897,643, filed on Oct. 30, 2013, provisional application No. 61/897,766, filed on Oct. 30, 2013, provisional application No. 61/897,120, filed on Oct. 29, 2013, provisional application No. 61/896,982, filed on Oct. 29, 2013.

(51) Int. Cl.
*F41C 23/02* (2006.01)
*F41A 5/18* (2006.01)

(52) U.S. Cl.
CPC ..... *F41C 23/02* (2013.01); *F41A 5/18* (2013.01)

(58) Field of Classification Search
CPC ..... F41C 23/02; F41C 33/002; F41A 5/18; F41A 5/20; F41A 5/22; F41A 5/24; F41A 5/26; F41A 5/28; F41A 5/30
USPC ..... 42/85; 89/191.01, 191.02, 192, 193
See application file for complete search history.

(56) References Cited

U.S. PATENT DOCUMENTS

| | | | |
|---|---|---|---|
| 1,290,853 | A | 1/1919 | Sturgeon |
| 1,352,414 | A | 9/1920 | Payne |
| 1,357,208 | A | 10/1920 | Payne |
| 1,402,459 | A | 1/1922 | Gustaf |
| 1,738,501 | A | 12/1929 | Moore |
| 1,789,835 | A | 1/1931 | Pedersen |
| 1,879,603 | A | 9/1932 | Coupland |
| 1,912,757 | A | 6/1933 | Brunnp |
| 2,102,622 | A | 12/1937 | Green |
| 2,110,165 | A | 3/1938 | Moore |
| 2,116,141 | A | 5/1938 | Browning |
| 2,124,075 | A | 7/1938 | Moore |
| 2,287,066 | A | 6/1942 | Rogers |
| 2,391,864 | A | 1/1946 | Chandler |
| 2,437,548 | A | 3/1948 | William |
| 2,467,372 | A | 4/1949 | De Permentier |

(Continued)

OTHER PUBLICATIONS

USPTO; Restriction Requirement dated Jul. 25, 2007 in U.S. Appl. No. 11/056,306.

(Continued)

*Primary Examiner* — Bret Hayes
(74) *Attorney, Agent, or Firm* — KW Law, LLP

(57) ABSTRACT

A gas block for a firearm may include a quick release sling attachment. The sling attachment utilizes a pin that engages with a bore in the body of the gas block. The sling attachment features a ring that can be in a fixed position or can swivel.

9 Claims, 14 Drawing Sheets

(56) References Cited

U.S. PATENT DOCUMENTS 2,480,662 A * 8/1949 McKinzie ..... F41C 23/02 42/85
2,482,880 A 9/1949 Sefried
2,570,292 A 10/1951 Umsted
2,642,689 A * 6/1953 Cline ..... F41C 23/02 42/85
2,771,699 A * 11/1956 Herter ..... F41C 23/02 42/85
2,816,484 A 12/1957 Grages
2,935,912 A 5/1960 Hartley
3,051,057 A 8/1962 Ivy
3,071,225 A 1/1963 Blau et al.
3,118,243 A 1/1964 Manshel
3,301,133 A 1/1967 Sturtevant
3,455,204 A 7/1969 Stoner
3,675,534 A 7/1972 Beretta
3,724,325 A 4/1973 Silsby
3,736,693 A 6/1973 Koch
3,908,214 A 9/1975 Doloreto
3,943,821 A 3/1976 Seifried
4,144,794 A * 3/1979 Silverman ..... G10G 5/005 224/257
4,244,273 A 1/1981 Langendorfer
4,246,830 A 1/1981 Krieger
4,521,985 A 6/1985 Smith et al.
4,536,982 A 8/1985 Bredbury
4,571,872 A * 2/1986 Johnson ..... F41C 23/02 224/150
4,576,083 A 3/1986 Seberger
H000107 H 8/1986 Bauer
D285,236 S 8/1986 Brunton
4,651,455 A 3/1987 Geiser
4,658,702 A 4/1987 Tatro
4,663,875 A 5/1987 Tatro
4,759,144 A 7/1988 Egan et al.
4,765,224 A 8/1988 Morris
4,937,964 A 7/1990 Crandall
5,067,267 A * 11/1991 Ives ..... F41C 23/02 224/150
D329,078 S 9/1992 Hasselbusch
5,183,959 A 2/1993 McCoan et al.
5,272,956 A 12/1993 Hudson
5,279,060 A * 1/1994 Watson ..... F41C 23/02 42/85
5,343,650 A 9/1994 Swan
5,351,598 A 10/1994 Schuetz
5,386,659 A 2/1995 Vaid et al.
5,479,737 A 1/1996 Osborne et al.
5,543,787 A 8/1996 Karidis et al.
5,551,179 A 9/1996 Young
5,590,484 A 1/1997 Mooney
5,634,288 A 6/1997 Martel
5,726,377 A 3/1998 Harris et al.
5,770,814 A 6/1998 Ealovega
D399,914 S 10/1998 Walker
5,827,992 A 10/1998 Harris et al.
5,930,935 A 8/1999 Griffin
5,945,626 A * 8/1999 Robbins ..... F41A 5/26 42/111
5,983,774 A 11/1999 Mihaita
6,070,352 A 6/2000 Daigle
6,113,285 A 9/2000 Ward
6,209,250 B1 4/2001 Mills
6,217,205 B1 4/2001 Ward
D447,791 S 9/2001 Robidoux
6,308,448 B1 10/2001 Kapusta et al.
6,345,460 B2 2/2002 Hashman
6,347,474 B1 2/2002 Wolff
D462,105 S 8/2002 Myers
6,470,615 B1 10/2002 Peterken
6,490,822 B1 12/2002 Swan
6,508,027 B1 1/2003 Kim
6,508,159 B1 1/2003 Muirhead
D477,855 S 7/2003 Selvaggio
6,606,812 B1 8/2003 Gwinn
6,634,274 B1 10/2003 Herring
6,681,677 B2 1/2004 Herring
6,694,660 B1 2/2004 Davies
6,722,072 B1 4/2004 McCormick et al.
6,722,255 B2 4/2004 Herring
6,779,288 B1 8/2004 Kim
6,827,130 B2 12/2004 Larson
6,839,998 B1 1/2005 Armstrong
6,848,351 B1 2/2005 Davies
6,854,206 B2 2/2005 Oz
D504,168 S 4/2005 McCormick
6,921,181 B2 7/2005 Yen
6,971,202 B2 12/2005 Bender
7,051,467 B1 5/2006 Huber
7,131,228 B2 11/2006 Hochstrate et al.
D544,063 S 6/2007 Swan
7,316,091 B1 1/2008 Desomma
7,363,741 B2 4/2008 Desomma
7,418,898 B1 9/2008 Desomma
7,421,937 B1 9/2008 Gangl
7,464,496 B1 12/2008 Davies
D590,473 S 4/2009 Fitzpatrick et al.
D593,617 S 6/2009 Dochternnan
7,584,567 B1 9/2009 Desomma
7,600,338 B2 10/2009 Geissele
D604,793 S 11/2009 Fitzpatrick et al.
7,654,027 B1 * 2/2010 Grover ..... F16B 21/165 24/573.11
7,753,679 B1 7/2010 Schuetz
7,784,211 B1 8/2010 Desomma
D624,609 S 9/2010 Stein et al.
7,798,045 B1 9/2010 Fitzpatrick et al.
7,827,722 B1 11/2010 Davies
D629,062 S 12/2010 Peterson et al.
7,856,917 B2 12/2010 Noveske
D630,698 S 1/2011 Peterson et al.
D631,933 S 2/2011 Thompson
7,891,284 B1 2/2011 Barrett
7,905,041 B1 3/2011 Davies
7,930,968 B2 4/2011 Giefing
D643,086 S 8/2011 Peterson et al.
D645,532 S 9/2011 Peterson et al.
8,056,460 B2 11/2011 Herring
8,091,265 B1 1/2012 Teetzel
8,109,196 B1 * 2/2012 Spence ..... F41A 5/24 89/193
8,161,864 B1 4/2012 Vuksanovich
8,230,634 B1 7/2012 Davies
8,261,653 B2 9/2012 Crommett
8,359,966 B1 1/2013 Brotherton
8,375,616 B2 2/2013 Gomez
8,381,628 B1 2/2013 Wheatly
8,479,428 B1 7/2013 Desomma
D708,693 S 7/2014 Faxon
D713,483 S 9/2014 Firpo
8,826,797 B2 9/2014 Overstreet
8,844,424 B2 9/2014 Gomez
D716,404 S 10/2014 Capps
8,863,637 B2 10/2014 Hall
8,869,674 B2 10/2014 Ruck
D717,904 S 11/2014 Oglesby
8,875,614 B2 11/2014 Gomez
D720,032 S 12/2014 Boutin
8,910,406 B1 12/2014 Huang
8,978,282 B2 3/2015 Garrett
9,032,860 B2 5/2015 Faxon
D741,978 S 10/2015 Shea
9,194,638 B2 11/2015 Larson et al.
D745,621 S 12/2015 Huang
D748,754 S 2/2016 Chastain
D750,725 S 3/2016 Capps
9,291,412 B1 3/2016 Montes
9,303,949 B1 4/2016 Oglesby
D755,339 S 5/2016 Geissele
D757,199 S 5/2016 Bender
D760,860 S 7/2016 Vincent
D763,397 S 8/2016 Huang
D764,004 S 8/2016 Bender

(56) References Cited

U.S. PATENT DOCUMENTS

| | | | | |
|---|---|---|---|---|
| 9,423,194 | B2 | 8/2016 | Fritz | |
| 9,429,375 | B2 | 8/2016 | DeSomma | |
| D768,801 | S | 10/2016 | Morris | |
| D771,767 | S | 11/2016 | Niswander | |
| 9,523,557 | B2 | 12/2016 | Sharron | |
| 9,523,558 | B2 | 12/2016 | Visinski | |
| 9,528,793 | B1 | 12/2016 | Oglesby | |
| D777,285 | S | 1/2017 | Bender | |
| 2003/0010186 | A1 | 1/2003 | Muirhead | |
| 2003/0010187 | A1 | 1/2003 | Muirhead | |
| 2003/0046853 | A1* | 3/2003 | Norris | A44B 11/006 42/85 |
| 2004/0064994 | A1 | 4/2004 | Luke | |
| 2004/0226212 | A1 | 11/2004 | Shiloni | |
| 2005/0000142 | A1 | 1/2005 | Kim et al. | |
| 2005/0223613 | A1 | 10/2005 | Bender | |
| 2005/0241211 | A1 | 11/2005 | Swan | |
| 2005/0262752 | A1 | 12/2005 | Robinson et al. | |
| 2005/0262997 | A1 | 12/2005 | Brixius | |
| 2006/0010748 | A1 | 1/2006 | Stoner et al. | |
| 2006/0026883 | A1 | 2/2006 | Hochstrate et al. | |
| 2006/0236582 | A1 | 10/2006 | Lewis et al. | |
| 2006/0254113 | A1* | 11/2006 | Esch | F41C 23/02 42/85 |
| 2006/0265925 | A1 | 11/2006 | Murello | |
| 2006/0265926 | A1 | 11/2006 | Sietsema | |
| 2006/0277810 | A1 | 12/2006 | Leitner-Wise | |
| 2006/0283318 | A1* | 12/2006 | Beaty | F41A 5/26 89/193 |
| 2007/0006509 | A1 | 1/2007 | Desomma et al. | |
| 2007/0033851 | A1 | 2/2007 | Hochstrate et al. | |
| 2007/0051236 | A1 | 3/2007 | Groves et al. | |
| 2007/0079539 | A1 | 4/2007 | Karagias | |
| 2007/0169393 | A1 | 7/2007 | Frost | |
| 2007/0180984 | A1 | 8/2007 | Huther | |
| 2007/0199435 | A1 | 8/2007 | Hochstrate et al. | |
| 2008/0078284 | A1 | 4/2008 | Murello | |
| 2009/0007478 | A1* | 1/2009 | Fluhr | F41A 5/26 42/90 |
| 2009/0223357 | A1 | 9/2009 | Herring | |
| 2009/0249672 | A1 | 10/2009 | Zedrosser | |
| 2009/0313873 | A1 | 12/2009 | Roth | |
| 2010/0000400 | A1 | 1/2010 | Brown | |
| 2010/0071541 | A1* | 3/2010 | Barrett | F41A 5/18 89/191.01 |
| 2010/0170133 | A1* | 7/2010 | Swan | F41C 23/02 42/85 |
| 2010/0251591 | A1 | 10/2010 | Burt | |
| 2010/0307042 | A1 | 12/2010 | Jarboe | |
| 2010/0319231 | A1 | 12/2010 | Stone et al. | |
| 2010/0319527 | A1 | 12/2010 | Giefing | |
| 2011/0000119 | A1 | 1/2011 | Desomma | |
| 2011/0016762 | A1 | 1/2011 | Davies | |
| 2011/0056107 | A1 | 3/2011 | Underwood | |
| 2011/0214327 | A1 | 9/2011 | Desomma | |
| 2011/0265638 | A1 | 11/2011 | Overstreet | |
| 2011/0271827 | A1 | 11/2011 | Larson | |
| 2011/0283580 | A1 | 11/2011 | Esch | |
| 2012/0117845 | A1 | 5/2012 | Desomma | |
| 2012/0167757 | A1 | 7/2012 | Gomez | |
| 2012/0174451 | A1 | 7/2012 | Overstreet | |
| 2012/0260793 | A1 | 10/2012 | Gomez | |
| 2012/0297656 | A1 | 11/2012 | Langevin | |
| 2013/0098235 | A1 | 4/2013 | Reinken | |
| 2013/0174721 | A1 | 7/2013 | Langevin | |
| 2013/0219763 | A1 | 8/2013 | Nunes | |
| 2013/0220295 | A1 | 8/2013 | Wood et al. | |
| 2013/0227869 | A1 | 9/2013 | Thordsen | |
| 2013/0305582 | A1* | 11/2013 | Mayberry | F41C 33/006 42/85 |
| 2013/0333168 | A1* | 12/2013 | Burnsed, Jr. | F41C 23/02 24/573.11 |
| 2014/0000142 | A1 | 1/2014 | Patel | |
| 2014/0060312 | A1 | 3/2014 | Ruck | |
| 2014/0075804 | A1 | 3/2014 | Langevin | |
| 2014/0076149 | A1 | 3/2014 | Adams | |
| 2014/0090283 | A1 | 4/2014 | Gomez | |
| 2014/0115938 | A1 | 5/2014 | Jarboe | |
| 2014/0224114 | A1 | 8/2014 | Faxon | |
| 2014/0260945 | A1 | 9/2014 | Desomma | |
| 2014/0311007 | A1 | 10/2014 | Capps | |
| 2014/0352191 | A1 | 12/2014 | Fritz | |
| 2015/0007476 | A1 | 1/2015 | Dextraze | |
| 2015/0040455 | A1 | 2/2015 | Lewis | |
| 2015/0168092 | A1 | 6/2015 | Stone | |
| 2015/0198409 | A1 | 7/2015 | Desomma | |
| 2015/0226501 | A1 | 8/2015 | Gibbens | |
| 2015/0253091 | A1 | 9/2015 | Gardner | |
| 2015/0260471 | A1* | 9/2015 | Azhocar | F41A 11/00 42/90 |
| 2015/0323269 | A1 | 11/2015 | McGinty | |
| 2015/0330733 | A1 | 11/2015 | Desomma | |
| 2015/0345879 | A1 | 12/2015 | Jen | |
| 2015/0362270 | A1 | 12/2015 | Stewart | |
| 2015/0369558 | A1 | 12/2015 | Gottzmann | |
| 2016/0123374 | A1* | 5/2016 | Roberts | F16B 45/00 294/215 |
| 2016/0146571 | A1* | 5/2016 | Howard | F41C 23/02 403/57 |
| 2016/0178297 | A1 | 6/2016 | Sharps | |
| 2016/0209137 | A1 | 7/2016 | DeSomma | |
| 2016/0209138 | A1 | 7/2016 | Desomma | |
| 2017/0051989 | A1 | 2/2017 | DeSomma | |
| 2017/0153075 | A1 | 6/2017 | DeSomma | |
| 2017/0307321 | A1 | 10/2017 | DeSomma | |

OTHER PUBLICATIONS

USPTO; Non-Final Office Action dated Oct. 10, 2007 in U.S. Appl. No. 11/056,306.
USPTO; Notice of Allowance dated May 9, 2008 in U.S. Appl. No. 11/056,306.
USPTO; Restriction Requirement dated Nov. 15, 2006 in U.S. Appl. No. 11/174,270.
USPTO; Non-Final Office Action dated Mar. 15, 2007 in U.S. Appl. No. 11/174,270.
USPTO; Final Office Action dated Sep. 26, 2007 in U.S. Appl. No. 11/174,270.
USPTO; Notice of Allowance dated Jan. 14, 2008 in U.S. Appl. No. 11/174,270.
USPTO; Non-Final Office Action dated Jan. 18, 2007 in U.S. Appl. No. 11/232,521.
USPTO; Final Office Action dated Jun. 15, 2007 in U.S. Appl. No. 11/232,521.
USPTO; Notice of Allowance dated Aug. 15, 2007 in U.S. Appl. No. 11/232,521.
USPTO; Non-Final Office Action dated Apr. 29, 2008 in U.S. Appl. No. 11/442,035.
USPTO; Notice of Allowance dated Sep. 30, 2008 in U.S. Appl. No. 11/442,035.
USPTO; Non-Final Office Action dated Dec. 27, 2007 in U.S. Appl. No. 11/527,851.
USPTO; Final Office Action dated Aug. 13, 2008 in U.S. Appl. No. 11/527,851.
USPTO; Non-Final Office Action dated Mar. 3, 2009 in U.S. Appl. No. 11/527,851.
USPTO; Final Office Action dated Sep. 1, 2009 in U.S. Appl. No. 11/527,851.
USPTO; Notice of Allowance dated Mar. 29, 2013 in U.S. Appl. No. 11/527,851.
USPTO; Non-Final Office Action dated Dec. 14, 2009 in U.S. Appl. No. 11/947,294.
USPTO; Notice of Allowance dated May 5, 2010 in U.S. Appl. No. 11/947,294.
USPTO; Non-Final Office Action dated Dec. 11, 2008 in U.S. Appl. No. 12/110,304.
USPTO; Notice of Allowance dated May 29, 2009 in U.S. Appl. No. 12/110,304.

(56) References Cited

OTHER PUBLICATIONS

USPTO; Non-Final Office Action dated Nov. 24, 2010 in U.S. Appl. No. 12/489,592.
USPTO; Notice of Allowance dated Mar. 3, 2011 in U.S. Appl. No. 12/489,592.
USPTO; Non-Final Office Action dated Feb. 17, 2013 in U.S. Appl. No. 12/497,048.
USPTO; Non-Final Office Action dated Feb. 15, 2012 in U.S. Appl. No. 13/098,196.
USPTO; Final Office Action dated Jun. 11, 2012 in U.S. Appl. No. 13/098,196.
USPTO; Non-Final Office Action dated Feb. 21, 2012 in U.S. Appl. No. 13/105,893.
USPTO; Final Office Action dated Apr. 13, 2012 in U.S. Appl. No. 13/105,893.
USPTO; Advisory Action dated Apr. 26, 2012 in U.S. Appl. No. 13/105,893.
USPTO; Notice of Allowance dated Jun. 22, 2012 in U.S. Appl. No. 13/105,893.
USPTO; Non-Final Office Action dated Feb. 15, 2012 in U.S. Appl. No. 13/358,347.
USPTO; Non-Final Office Action dated Jun. 6, 2012 in U.S. Appl. No. 13/358,347.
USPTO; Non-Final Office Action dated Feb. 27, 2013 in U.S. Appl. No. 13/708,025.
USPTO; Final Office Action dated Sep. 26, 2013 in U.S. Appl. No. 13/708,025.
USPTO; Non-Final Office Action dated Dec. 17, 2013 in U.S. Appl. No. 13/835,842.
USPTO; Final Office Action dated Jun. 4, 2014 in U.S. Appl. No. 13/835,842.
USPTO; Non-Final Office Action dated Oct. 24, 2014 in U.S. Appl. No. 13/835,842.
USPTO; Final Office Action dated Jun. 18, 2015 in U.S. Appl. No. 13/835,842.
USPTO; Non-Final Office Action dated Jan. 5, 2016 in U.S. Appl. No. 13/835,842.
USPTO; Final Office Action dated Jun. 1, 2016 in U.S. Appl. No. 13/835,842.
USPTO; Non-Final Office Action dated Jan. 29, 2015 in U.S. Appl. No. 14/216,733.
USPTO; Final Office Action dated Jul. 16, 2015 in U.S. Appl. No. 14/216,733.
USPTO; Non-Final Office Action dated Jan. 14, 2016 in U.S. Appl. No. 14/527,698.
USPTO; Notice of Allowance dated Apr. 25, 2016 in U.S. Appl. No. 14/527,698.
USPTO; Non-Final Office Action dated Aug. 17, 2015 in U.S. Appl. No. 14/596,018.
USPTO; Non-Final Office Action dated Jun. 23, 2016 in U.S. Appl. No. 15,002,096.
USPTO; Non-Final Office Action dated Jun. 22, 2016 in U.S. Appl. No. 15,002,382.
USPTO; Restriction Requirement dated Apr. 24, 2014 in U.S. Appl. No. 29/449,556.
USPTO; Notice of Allowance dated Jul. 7, 2014 in U.S. Appl. No. 29/449,556.
USPTO; Notice of Allowance dated Oct. 13, 2015 in U.S. Appl. No. 29/502,433.
USPTO; Non-Final Office Action dated Dec. 1, 2016 in U.S. Appl. No. 13/835,842.
USPTO; Final Office Action dated Dec. 27, 2016 in U.S. Appl. No. 15/002,096.
USPTO; Notice of Allowance dated Jan. 11, 2017 in U.S. Appl. No. 29/551,847.
USPTO; Restriction Requirement Office Action dated Jan. 27, 2017 in U.S. Appl. No. 15/002,382.
USPTO; Notice of Allowance dated Mar. 30, 2017 in U.S. Appl. No. 29/551,237.
USPTO; Non-Final Office Action dated Apr. 10, 2017 in U.S. Appl. No. 15/002,096.
USPTO; Final Office Action dated May 19, 2017 in U.S. Appl. No. 15/002,382.
USPTO; Non-Final Office Action dated Jun. 13, 2017 in U.S. Appl. No. 15/250,218.
USPTO; Final Office Action dated Jun. 28, 2017 in U.S. Appl. No. 13/835,842.
USPTO; Final Office Action dated Sep. 28, 2017 in U.S. Appl. No. 15/002,096.
USPTO; Restriction Requirement Office Action dated Oct. 31, 2017 in U.S. Appl. No. 15/410,534.
USPTO; Restriction Requirement Office Action dated Oct. 16, 2017 in U.S. Appl. No. 15/342,981.
USPTO; Office Action dated Jan. 9, 2018 in U.S. Appl. No. 13/835,842.
USPTO; Office Action dated Dec. 12, 2017 in U.S. Appl. No. 15/002,382.
USPTO; Office Action dated Jan. 18, 2018 in U.S. Appl. No. 15/410,534.
USPTO; Non-Final Office Action dated Feb. 1, 2018 in U.S. Appl. No. 15/342,981.
USPTO; Notice of Allowance dated Mar. 26, 2018 in U.S. Appl. No. 15/002,096.
USPTO; Notice of Allowance dated Mar. 29, 2018 in U.S. Appl. No. 15/250,218.
POF-USA Patriot Ordnance Factory, Inc., Upper Receiver web page, Retrieved from http://web.archive.org/web/20100922070336/http://www.pof-usa.com/upper/upperreceiver.html[Sep. 17, 2012 9:19:17 AM].
Rainer Arms Forged Mil-Spec Upper Minus FA 9mm / .22 LR, RainierArms.com, [online], [site visited Dec. 30, 2016]. <URL: http://www.rainierarms.com/rainier-arms-forged-mil-spec-upper-minus-fa-22-lr>.
Rainer Arms Forged A4 Upper Receiver-GEN2, RainierArms.com, [online], [site visited Dec. 30, 2016]. <URL: http://www.rainierarms.com/rainier-arms-forged-A4-upper-receiver-gen2>.
Rainer Arms Forged Mil-Spec Upper Minus FA 1/LOGO, RainierArms.com, [online], [site visited Dec. 30, 2016]. <URL: http://www.rainierarms.com/rainier-arms-forged-mil-spec-upper-minus-fa-w-logo>.
BCM M4 Arms Upper Receiver Assembly, RainierArms.com, [online], [site visited Dec. 30, 2016]. <URL: http://www.rainierarms.com/bcm-m4-upper-receiver-assembly>.
NorthTech Defense Non Forward Assist AR15 Billet Upper Receiver, RainierArms.com, [online], [site visited Dec. 30, 2016]. <URL: http://www.rainierarms.com/northtech-defense-non-forward-assist-ar15-billet-upper-receiver>.
SAAAR 15 Stripped Flat Top Upper Receiever—No Mark, SurplusAmmo.com, [online], [site visited Dec. 30, 2016]. <URL: http://www.surplusammo.com/saa-ar15-stripped-flat-top-upper-receiver-no-mark/>.
Aero Precision Assembled AR-15 Upper receiever with Port Door and Forward Assist, PrimaryArms.com, [online], [site visited Dec. 30, 2016]. URL: http://www.primaryarms.com/aero-precision-assembled-ar-15-upper-receiver-with-port-door-and-forward-assist-ap501603-asmbly>.
Anderson Manufacturing AR-15 Stripped Upper Receiver, PrimaryArms.com, [online], [site visited Dec. 30, 2016]. <URL: http://www.primaryarms.com/anderson-manufacturing-ar-15-stripped-upper-receiver-ar-15-a3-upfor-um>.
Vltor MUR Modular Upper Receiver with Shell Deflector Only Assembled AR-15 Matte, MidwayUSA.com, [online], [site visited Dec. 30, 2016]. <URL: http://www.midwayusa.com/product/478529/vltor-mur-modular-upper-receiver-with-shell-deflector-only-assembled-ar-15-matte>.
LanTac USA LA00221 AR-15 UAR Stripped Upper Receiver 5.56mm Black, TombStoneTactical.com, [online], [site visited Dec. 13, 2016]. <URL: http://www.tombstonetactical.com/catalog/lantac-usa/la00221-ar15-uar-stripped-upper-receiver-5.56mm-black/>.
AR15-A3 Stripped Upper Receiver, FrederickArms.com, [online], [site visited Dec. 30, 2016]. <URL:http://www.frederickarms.com/ar15-a3-stripped-upper-receiver.html>.

(56) References Cited

OTHER PUBLICATIONS

Upper Receiver AR-15, CrossHairCustoms.com, [online], [site visited Dec. 30, 2016]. <URL: http://www.crosshaircustoms.com'/product/ar-15-upper-receiver/>.
Always Armed, "First AR Build (for myself that is)", Mar. 23, 2014, MossbergOwners.com, <http://mossergowners.com/forum/index.php?threads/first-ar-build-for-myslef-that-is.11491/page-4>, Entire thread, Accessed Sep. 22, 2017.
Paulo_Santos, PWS & POF Enhanced Buffer Tube Review, Feb. 9, 2011, Weapon Evolution, <http://www.weaponevolution.com/forum/showthread.php?3005-PWS-amp-POF-Enhanced-Buffer-Tube-Reviews>, Entire thread, Accessed Sep. 22, 2017.

* cited by examiner

GAS BLOCK WITH QUICK RELEASE SLING ATTACHMENT

CROSS REFERENCE TO RELATED APPLICATIONS

This application is a continuation of and claims priority to U.S. Ser. No. 15/250,218 entitled "AMBIDEXTROUS BOLT HOLD OPEN", filed on Aug. 29, 2016. The '218 application is a continuation of and claims priority to U.S. Pat. No. 9,429,375 issued on Aug. 30, 2016 (aka Ser. No. 14/527,698 filed on Oct. 29, 2014) and entitled "SYSTEMS AND METHODS FOR IMPROVED FIREARM FUNCTION", the entire disclosure of which is incorporated herein by reference for any purpose. The '698 application claims the benefit of and priority to U.S. Ser. No. 61/897,643, entitled "SYSTEMS AND METHODS FOR AMBIDEXTROUS MAGAZINE RELEASE," filed on Oct. 30, 2013, the entire disclosure of which is incorporated herein by reference for any purpose. The '698 application claims the benefit of and priority to U.S. Ser. No. 61/897,766, entitled "SYSTEMS AND METHODS FOR AMBIDEXTROUS BOLT HOLD OPEN," filed on Oct. 30, 2013, the entire disclosure of which is incorporated herein by reference for any purpose. The '698 application claims the benefit of and priority to U.S. Ser. No. 61/897,120, entitled "RECEIVER ASSEMBLY TENSIONING SYSTEM," filed on Oct. 29, 2013, the entire disclosure of which is incorporated herein by reference for any purpose. The '698 application claims the benefit of and priority to U.S. Ser. No. 61/896,982, entitled "GAS BLOCK WITH QUICK RELEASE SLING ATTACHMENT" filed on Oct. 29, 2013, the entire disclosure of which is incorporated herein by reference for any purpose.

FIELD

This invention relates to firearms. More particularly, the present invention relates to firearms having a gas block with a quick release sling attachment.

SUMMARY

In various embodiments, an AR-15/M-16 style rifle may comprise a bolt carrier assembly, an upper receiver, and a lower receiver. The upper receiver may be configured to carry the bolt carrier assembly. The bolt carrier assembly may be configured to cycle within the buffer system of an upper receiver. The lower receiver may be configured to operatively couple to the upper receiver. The lower receiver may include a bolt catch. The bolt catch may be pivotally coupled to and installed in the lower receiver. A bolt catch actuator may be operatively installed within the lower receiver and protruding into an area defined by a trigger guard of the lower receiver. The bolt catch actuator may be configured to advance the bolt catch to a position within the upper receiver to engage the bolt carrier assembly and retain the bolt carrier assembly in an out-of-battery configuration in response to a first input from a user. The bolt carrier assembly may be advanced to a battery position in response to a second input from a user to at least one of the bolt catch and the bolt catch actuator.

In various embodiments, a firearm assembly tensioning system may comprise a first firearm component, a second firearm component, and a firearm assembly tensioning system. The first firearm components may comprise a first component mating surface. The second firearm component may comprise a second component mating surface. The firearm assembly tensioning device may be disposed in one of the first component mating surface or the second component mating surface. The first firearm component and the second firearm component may be detachably coupled to one another by a coupling mechanism. The firearm assembly tensioning device may further comprise a set screw receiving member and a set screw. The set screw receiving member may be configured to receive a set screw. The set screw receiving member disposed in a first mating surface of a first firearm component. The set screw may include an insertion end configured to be inserted in the set screw receiving member. The set screw may also include a protruding end configured to opposably engage a portion of a second mating surface of a second firearm component. The distance of protrusion of the protruding end of the set screw relative to the first mating surface may be adjusted.

In various embodiments, a firearm gas block may comprise a body, a sling pin and a ring. The body may define a gas port, a barrel bore, and a sling pin bore. The sling pin may be removably installed within the sling pin bore. The ring may be coupled to the sling pin. The ring may be a swivel-type or a fixed-type ring.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

FIG. 4C illustrates a perspective view of a lower receiver for an AR-15/M-16 style rifle including a tensioning system, in accordance with various embodiments.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Different cross-hatching and/or surface shading may be used throughout the figures to denote different parts but not necessarily to denote the same or different materials.

The features and elements disclosed herein may be combined in various combinations without exclusivity, unless expressly indicated herein otherwise. These features and elements as well as the operation of the disclosed embodiments will become more apparent in light of the following description and accompanying drawings.

The various systems described herein are described in the context of and operation of an AR-15/M-16 style rifle. However, the system may be used on any suitable firearm and/or other device where the various systems may improve the function, reliability and/or manufacturability of the system. Moreover, the various systems described herein may be used independently or in conjunction with one another. In this regard, various portions of the systems described herein may be used with various other portions of the systems described herein.

Figure 1:
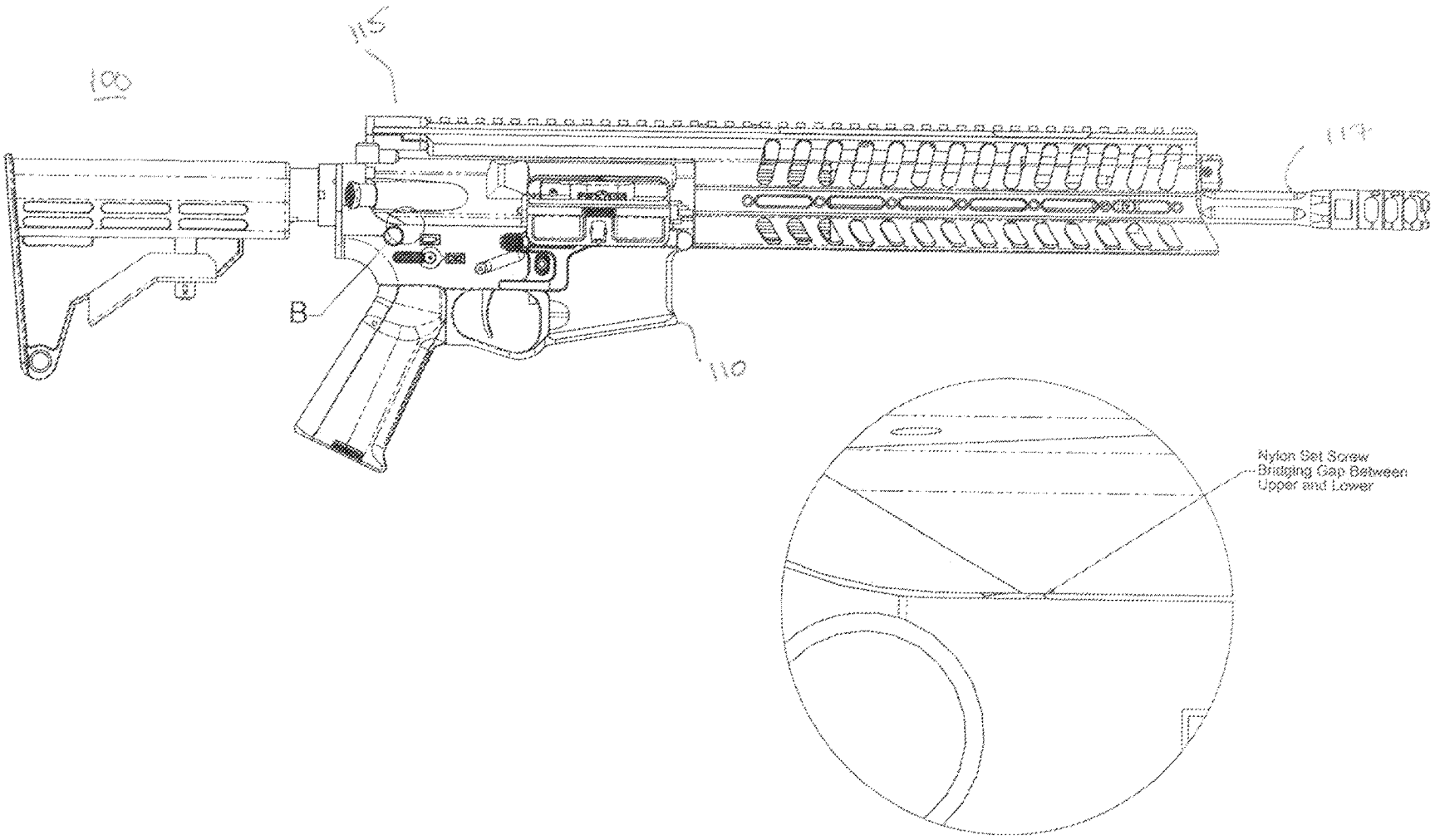
FIG. 1 illustrates an exemplary firearm, in accordance with various embodiments.
Figure 2A:
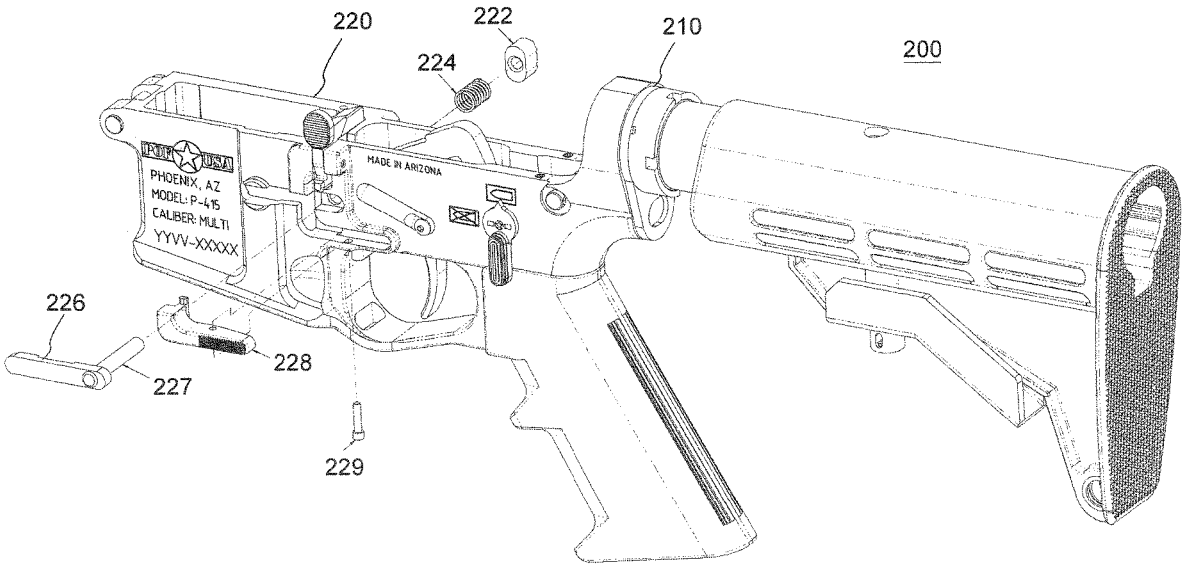
FIG. 2A illustrates a partially exploded perspective view of a lower receiver, in accordance with various embodiments.
Figure 2D:
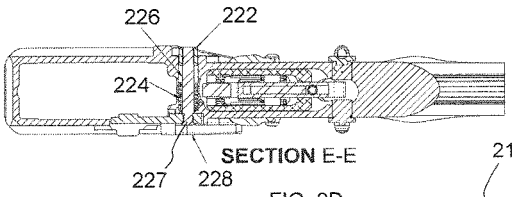
FIG. 2D illustrates a bottom cross-sectional view along cut plane E-E of a portion of a lower receiver, in accordance with various embodiments.
Figure 2B:
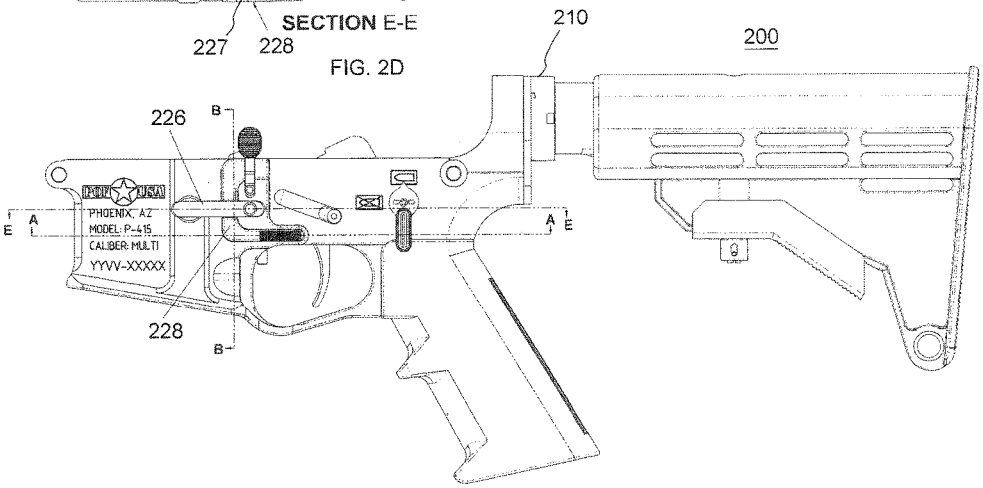
FIG. 2B illustrates a side view of a lower receiver, in accordance with various embodiments.
Figure 2E:
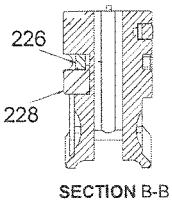
FIG. 2E illustrates a cross-sectional view along cut plane B-B of a portion of a lower receiver, in accordance with various embodiments.
Figure 2C:
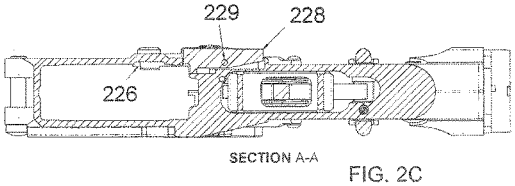
FIG. 2C illustrates a top cross-sectional view along cut plane A-A of a portion of a lower receiver, in accordance with various embodiments.

In various embodiments and with reference to FIG. 1, a firearm 100 and more specifically AR-15 style rifles may comprise a lower receiver 110 and an upper receiver 115. Firearm 100 may also comprise a barrel 117. Lower receiver 110 and upper receiver 115 may be detachably coupled to one another using a coupling mechanism (e.g., a pin and catch system).

As used herein, terms such as axial, lateral, vertical, forward, rearward, upper, and lower, among others, are used to provide a relative frame of reference for explanatory purposes and are not intended to limit the disclosure. For example, the term axial generally denotes a direction substantially parallel to a longitudinal length of firearm 100, while the term lateral generally denotes a direction substantially perpendicular to a plane that bisects firearm 100. The term vertical generally denotes a direction that is substantially perpendicular to the axial and lateral directions. The vertical direction is substantially perpendicular to the ground when the firearm 100 held with the barrel 117 substantially parallel to the ground, but not otherwise.

In various embodiments, typical AR-15/M-16 style rifles may generally comprise a right-handed magazine release. This magazine release allows an operator to depress a magazine release button and remove a detachable magazine from the lower receiver of the rifle. In response to being activated, the button forces the lever away from the magazine (e.g., radially away from the centerline of the rifle) allowing the magazine to drop free and/or be removed from the magazine well. Moreover, where a typical system is employed, the button is installed on the right side of the rifle and, as such, must be activated on the right side of the rifle. Stated another way, this configuration allows a magazine to be released from one side of the rifle. This configuration may cause a user to have to reach over or around from the left side to the right side of the rifle to release the magazine.

In various embodiments and with reference to FIGS. 2A-2F, magazine release system 220 may comprise a magazine release button 222, a magazine catch spring 224, a magazine catch 226, an ambidextrous magazine release button 228, and a pivot screw 229. Magazine release system 220 may be installed on lower receiver 210 of firearm 200.

In various embodiments, magazine release button 222 may house and be operatively moveable. Magazine catch spring 224 may operatively install on and/or at least partially within magazine release button 222. Magazine catch spring 224 may install in the right side of lower receiver 210 and be covered and/or contained by magazine release button 222. In this regard, magazine release button may reciprocally move relative to lower receiver 210, in response to being depressed and/or compressing magazine catch spring 224. This configuration may be similar to the typical configuration found in a standard or mil spec AR-15/M-16 style rifle. Magazine catch spring 224 may compress and then rebound in response to the user depressing and then releasing or minimizing the pressure exerted on magazine release button 222.

In various embodiments, magazine release button 222 may operatively couple to and/or engage magazine catch 226. An actuation rod 227 of magazine catch 226 may install through lower receiver 210 through magazine catch spring 224 to seat and/or be actuatable by magazine release button 222. In this regard, pressure on and/or actuation of magazine release button 222 may cause magazine catch 226 to actuate radially outward from lower receiver 210 and/or radially away from lower receiver 210. This would allow a magazine to drop free and/or be removed from the magazine well.

In various embodiments, ambidextrous magazine release button 228 may also be operatively coupled to and/or may operatively contact magazine catch 226. Ambidextrous magazine release button 228 may be operatively installed in lower receiver 210. Moreover, ambidextrous magazine release button 228 may be secured within lower receiver 210 by pivot screw 229. In operation, ambidextrous magazine release button 228 may be configured to pivot about and/or actuate on the axis created by pivot screw 229. The pivoting and/or actuation of ambidextrous magazine release button 228 may cause magazine catch 226 to actuate away from the centerline of lower receiver 210 and away from magazine release button 222. In this regard, the magazine is releasable from either side (e.g., the right or the left side of the rifle).

In various embodiments, ambidextrous magazine release system 220 provides a user with a rifle with greater functionality and usability. Moreover, the rifle may be used, operated and/or reloaded easily by a shooter that is either right-handed or left-handed. Stated another way, the magazine may be released by actuating the magazine actuation system from either the right of the left side of the rifle and/or lower receiver 210.

Figure 3A:
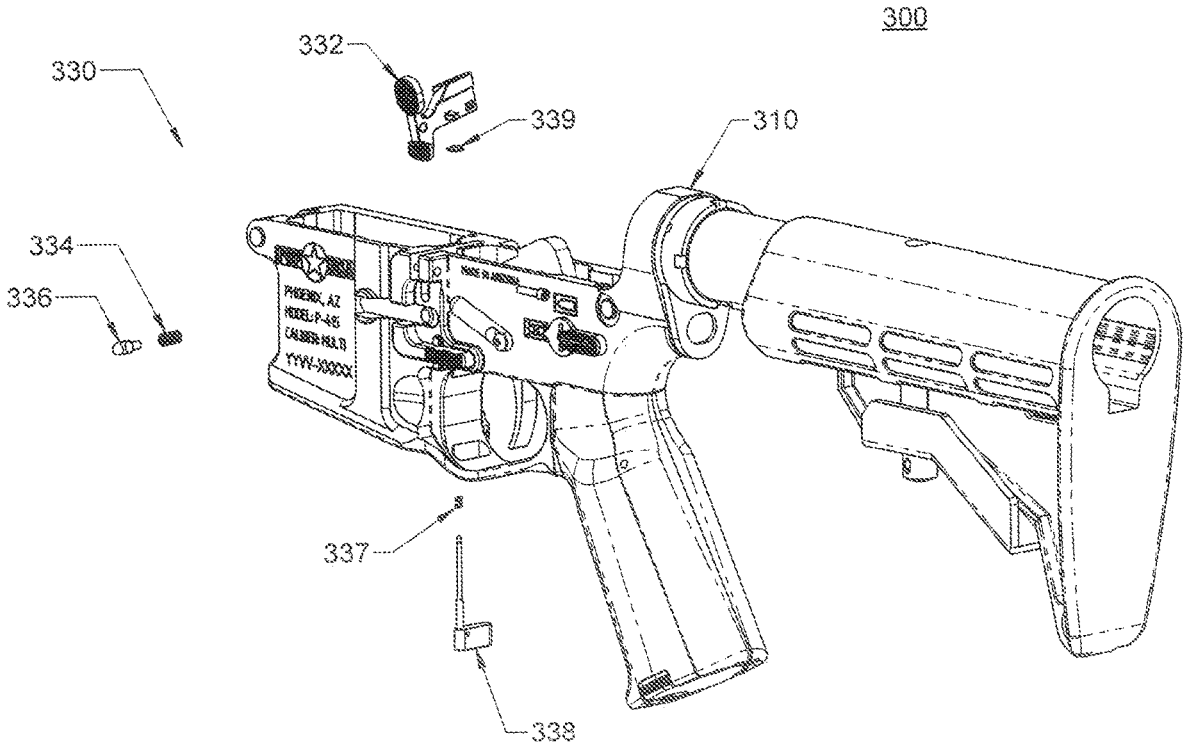
FIG. 3A illustrates a partially exploded perspective view of a lower receiver, in accordance with various embodiments.
Figure 3B:
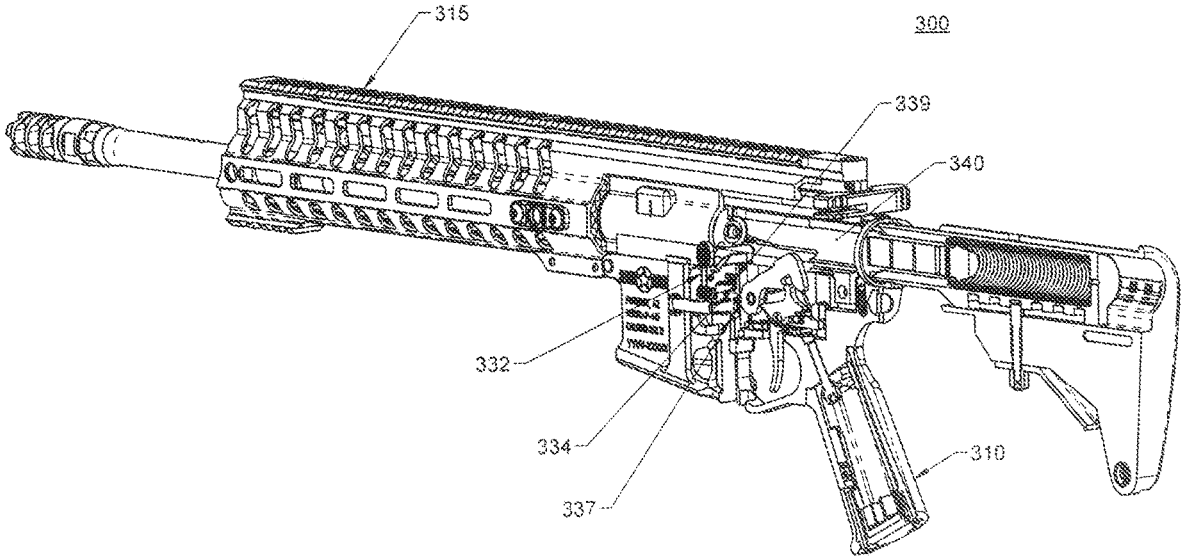
FIG. 3B illustrates a partial cross-sectional perspective view of an AR-15/M-16 style rifle, in accordance with various embodiments.
Figure 3C:
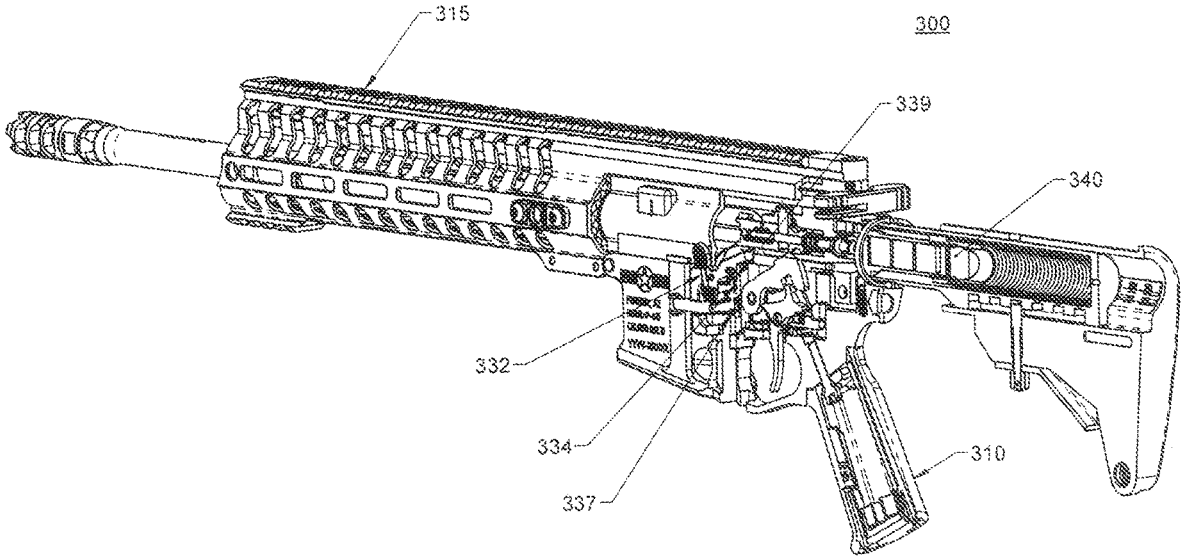
FIG. 3C illustrates a partial cross-sectional perspective view of an AR-15/M-16 style rifle comprising a bolt, in accordance with various embodiments.
Figure 3D:
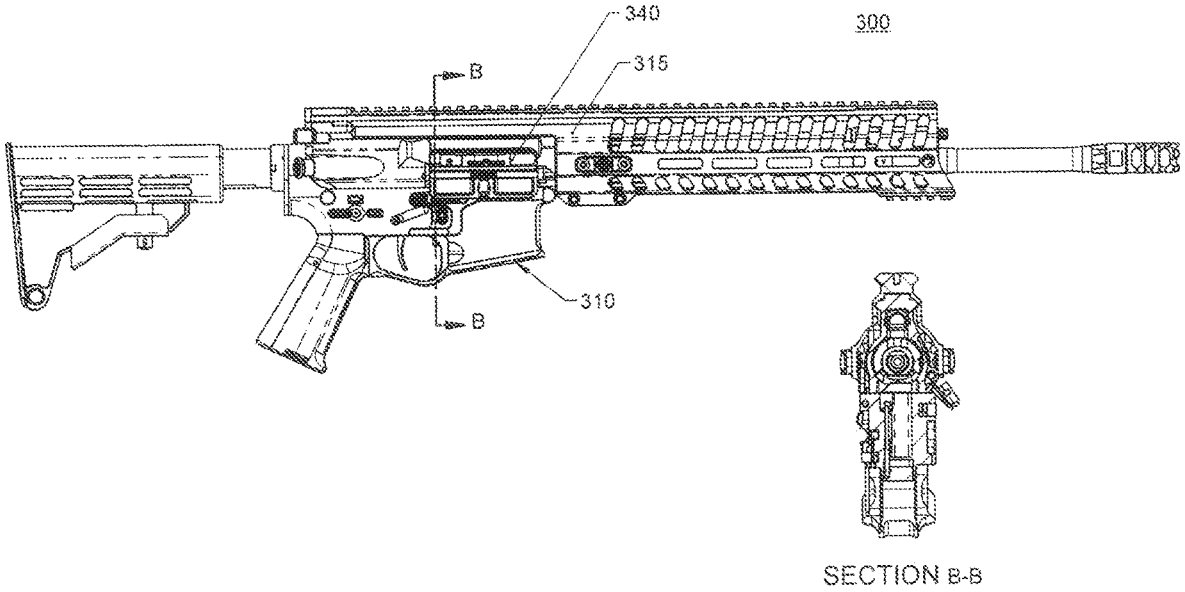
FIG. 3D illustrates a side view of an AR-15/M-16 style rifle including a bolt in the closed and/or battery position, in accordance with various embodiments.
Figure 3E:
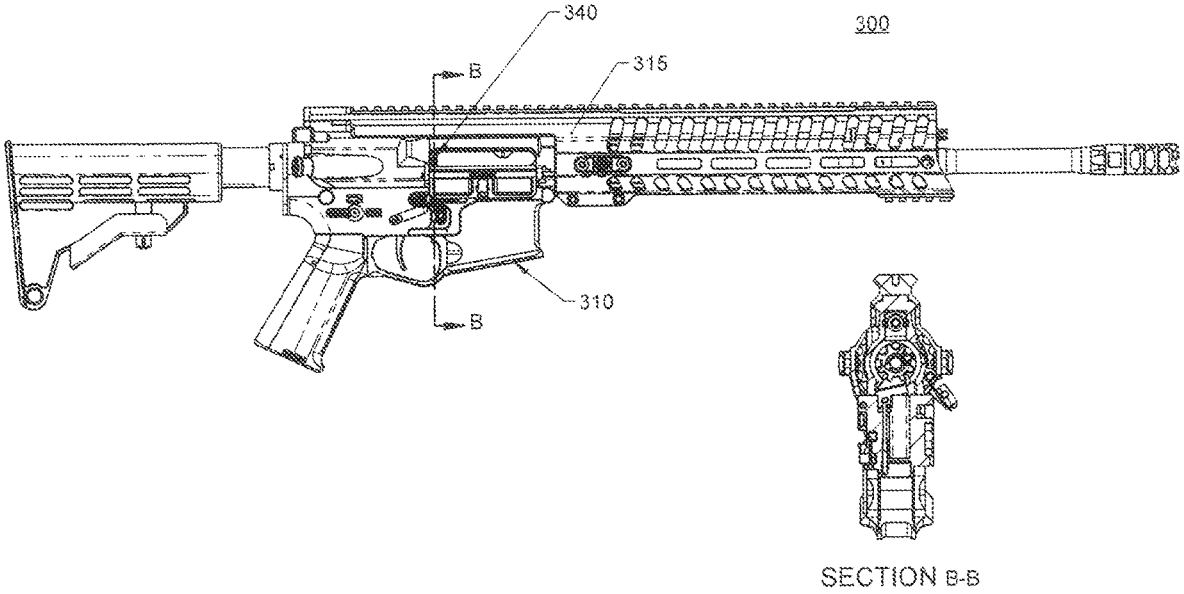
FIG. 3E illustrates a side view of an AR-15/M-16 style rifle including a bolt in the open and/or out-of-battery position, in accordance with various embodiments.
Figure 4A:
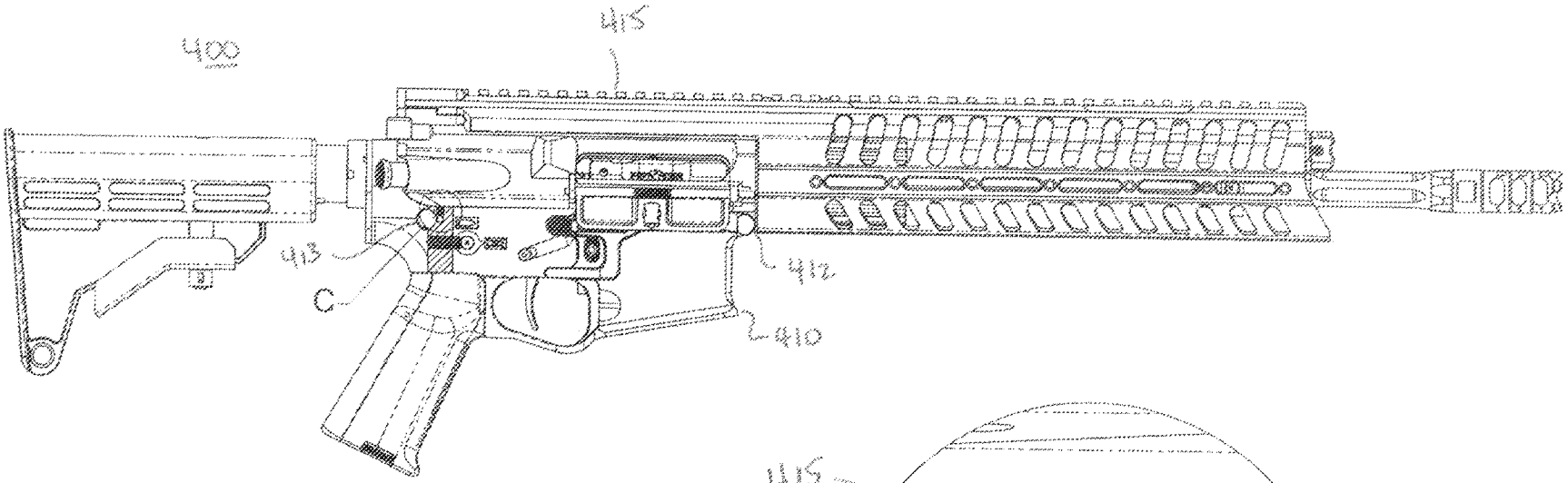
FIG. 4A illustrates a side view of an AR-15/M-16 style rifle comprising a tensioning system in accordance with various embodiments.
Figure 4B:
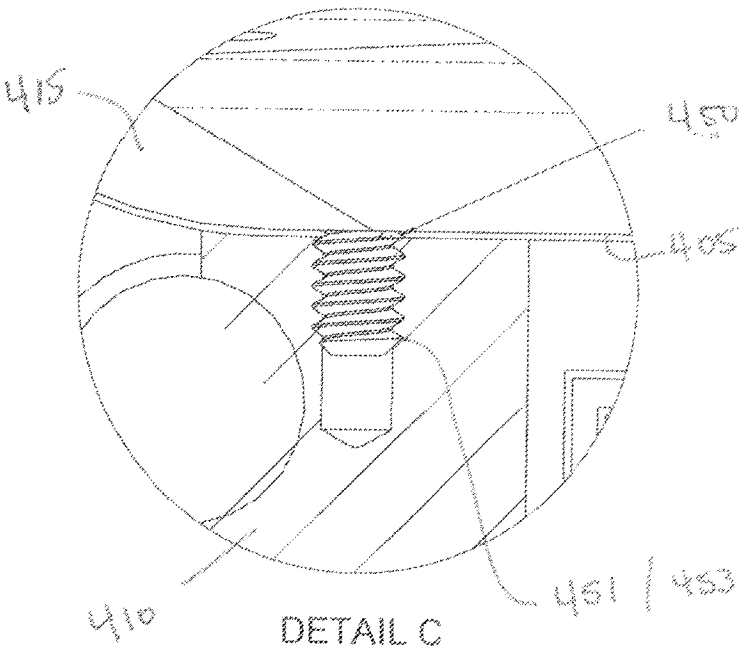
FIG. 4B illustrates a side cross-sectional view of a portion of an AR-15/M-16 style rifle including tensioning system components in accordance with various embodiments.
Figure 11E:
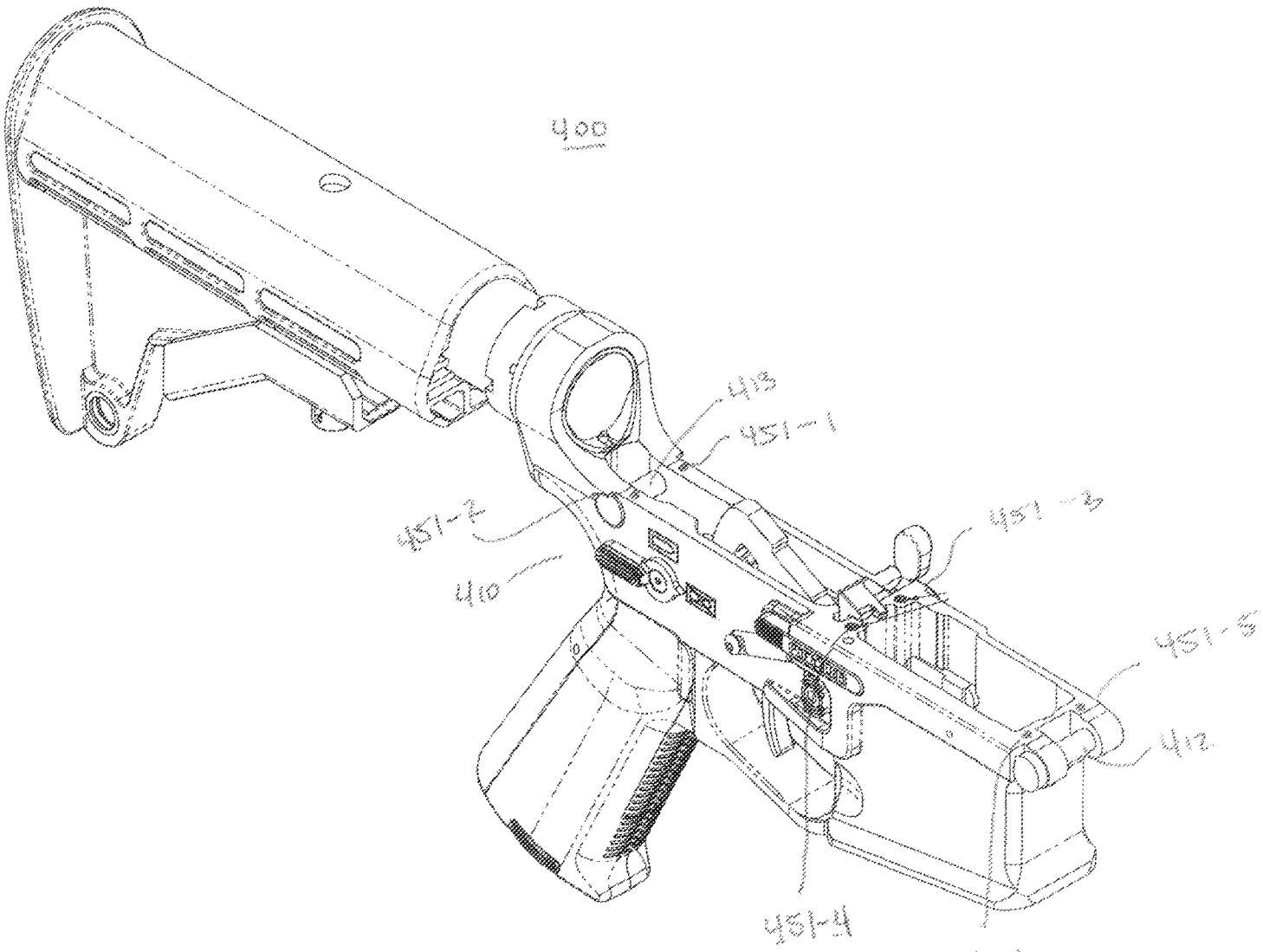
Figure 4D:
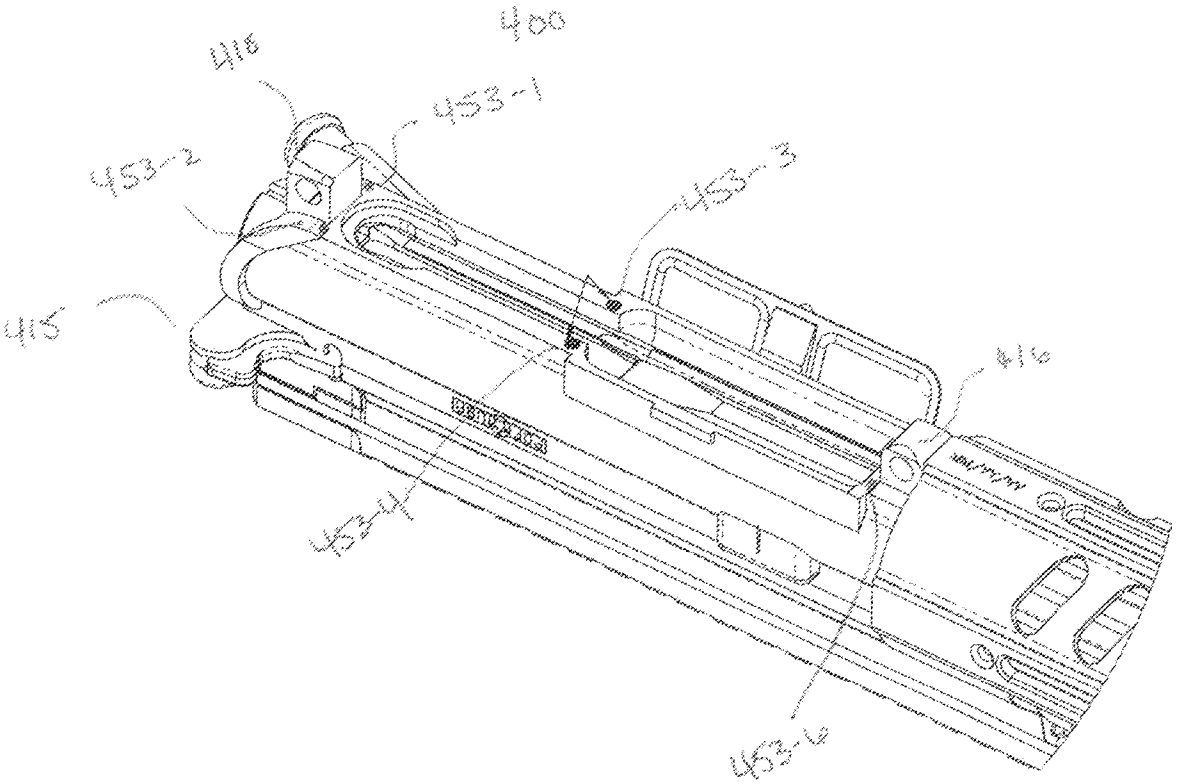
FIG. 4D illustrates a perspective view of an upper receiver for an AR-15/M-16 style rifle including a tensioning system, in accordance with various embodiments.

In various embodiments and with reference to FIGS. 3A-3E, a bolt hold open system 330 is provided. Bolt hold open system 330 may comprise a bolt catch 332, a bolt catch spring 334, a bolt catch plunger 336, a bolt catch actuator 338, a return spring 337 and a retaining clip 339. Bolt hold open system 330 may be installable in an AR-15/M-16 style lower receiver 310. Moreover, bolt hold open system 330 may be configured, when installed in lower receiver 310 as part of a complete rifle 300, to retain a bolt carrier assembly 340 in upper receiver 315 in the out-of-battery position, as shown in FIG. 3E.

In various embodiments, bolt catch 332 may be operatively coupled and/or installed within lower receiver 310. Bolt catch actuator 338 may be installed in lower receiver 310. Bolt catch actuator 338 may also operatively couple to bolt catch 332. In this regard, bolt catch 332 and bolt catch actuator 338 may be retained to one another with retaining clip 339. Moreover, bolt catch actuator 338 may be biased in the stowed position (e.g., the position where bolt carrier 340 is allowed to cycle or be in the battery position as shown in FIG. 3D) by return spring 337. In this regard, when the bolt catch 332 is actuated (e.g., when bolt carrier 340 is released and allowed to move to the battery position) bolt catch actuator 338 may travel down and/or into the trigger guard.

In various embodiments, bolt catch 332 may pivot within lower receiver 310. When the bolt catch is engaged, the bolt catch 332 may pivot causing bolt catch plunger 336 to be contacted by bolt catch 332 and compress bolt catch spring 334. In response to bolt catch 332 being released and/or pivoted to the stowed position (e.g., allowing bolt carrier 340 to advance to the battery position), bolt catch spring 334 may bias and/or return bolt catch plunger 336 to the stowed position.

In various embodiments and with reference to FIGS. 3A-3E, in operation bolt catch actuator 338 may be installed in the trigger guard of lower receiver 310. This configuration may provide any user with an accessible, ambidextrous bolt hold open system. In this regard, a right handed or left handed operator may actuate the bolt hold open system by contacting the bolt catch actuator with a finger from the hand used to fire an AR-15/M-16 style rifle and/or actuate the trigger.

In various embodiments, bolt hold open system 330 may provide an operator with a way to safely and easily retain bolt carrier 340 in an out-of-battery position regardless of whether the rifle has ammunition and/or a magazine. In training and/or operational scenarios this may allow an operator to safely travel with, transport, and/or otherwise handle rifle 300.

In various embodiments, a firearm may comprise a firearm assembly tensioning system. The tensioning system may comprise a tensioning device that provides for adjustable tension between detachably coupleable components of a firearm, such as the lower receiver and the upper receiver of a firearm, when the components are coupled to one another. The tensioning system may be implemented or used with any suitable firearm comprising two detachably coupleable components.

In various embodiments and with reference to FIGS. 4A-4D, a coupling mechanism may be selectively releasable so that firearm 400 may be moved between an assembled (i.e., coupled) position and a disassembled (i.e., uncoupled or partially uncoupled) position. In the assembled position, the lower receiver 410 is coupled to the upper receiver 415 so that the firearm 400 can fire a round or ammunition. In the disassembled position, the upper receiver 415 is at least partially separated from the lower receiver 410, such as, for example, by uncoupling the assembled firearm at a rearward pin and pivoting the components with respect to one another about a forward pin so that the firearm can be serviced and/or cleaned.

In various embodiments, a coupling mechanism may include pivot pin 412 (i.e., a forward pin) and takedown pin 413 (i.e., a rearward pin). Pivot pin 412 may pass through and operatively engage a pivot lug 416 of upper receiver 415. This configuration may provide that upper receiver 415 is rotatably coupled to lower receiver 410. Takedown pin 413 may pass through and engage a retention lug 418. When takedown pin 413 is installed in retention lug 418, lower receiver 410 is operatively coupled to upper receiver 415. In this regard, firearm 400 is assembled. However, the tolerance of various parts and/or wear on various parts may create and/or provide for movement and/or "slop" between upper receiver 415 and lower receiver 410. The movement may contribute to wear, may create a "rattle" or noise in the assembly and/or may be aesthetically displeasing.

In various embodiments, a gap 405 may exist between upper receiver 415 and lower receiver 410 when firearm 400 is assembled. Gap 405 may be defined between at least a portion of the mating surfaces of lower receiver 410 and the upper receiver 415.

In various embodiments, at least one of the lower receiver 410 or the upper receiver 425 may comprise a tensioning system 450 that may be used to adjust tension between lower receiver 410 and the upper receiver 415 when they are the assembled.

In various embodiments, tensioning system 450 may be installed in and/or may be a portion of lower receiver 410 and/or upper receiver 415. Tensioning system 450 may comprise one or more set screws 451/453 that are configured to bridge gap 405 between upper receiver 415 and lower receiver 410. For example, tensioning system 450 may comprise one or more with a nylon set screws 451 (shown as set screw 451-1, set screw 451-2, set screw 451-3, set screw 451-4, set screw 451-5, and/or set screw 451-6 in lower receiver 410 in FIG. 4C). Similarly, Tensioning system 450 may comprise one or more with a nylon set screws 453 (shown as set screw 453-1, set screw 453-2, set screw 453-3, set screw 453-4, set screw 453-5, and/or set screw 453-6 in upper receiver 415 in FIG. 4D). Set screws 451 may be installed in upper receiver 415 and/or lower receiver 410 in any suitable fashion. For example, set screws 451/453 may be installed symmetrically about a centerline of upper receiver 415 and/or lower receiver 410 in pairs. Any number of set screws 451/453 may be installed in upper receiver 415 and/or lower receiver 410. For example, a single set screw 451/453 or a single pair of set screws 451/453 may be installed in upper receiver 415 and/or lower receiver 410. In this regard, tensioning system 450 allows a user to adjust the movement out of firearm 400 by bridging gap 105. Moreover, tensioning system is adapted and/or adjustable as gap 105 changes due to wear, temperature, part replacement, part modification, part painting, and/or the like.

In various embodiments, each set screw 451/453 may be independently adjustable. In this regard, each set screw 451/453 may include a threaded length that allows a user to adjust the length of set screw 451/453 that protrudes from lower receiver 410 and/or upper receiver 415.

In various other embodiments, the size of a gap between two components may be dependent on the fit of the corresponding mating surfaces and/or the precision of the coupling mechanism used to detachably couple the two components. In accordance with various embodiments, the adjustability afforded by the components of the tensioning system described herein permits the set screw to be adjusted to securely engage the opposing surface of a coupled component.

In various embodiments, a component of tensioning system 450 may be removed from a firearm component or may be adjusted into a firearm component so that the tensioning device is flush with or recessed with respect to the mating surface of the firearm component in which the tensioning device is disposed. For example, set screw 45 may be removed from lower receiver 410, or set screw 451 may be threaded into lower receiver 410 such that surface set screw 451 is flush with or below the mating surface of lower receiver 410.

In various embodiments, set screw 451 and/or set screw 453 of tensioning system 450 may be made of a material that is elastically deformable in response to an applied compressive force. For example, set screw 451/453 may be made of any suitable polymer material, such as nylon, ABS, acrylic, polycarbonate, polyimide, and the like. Set screw 451/453 may be a material suitable to provide the desired elastically deformable properties under extreme environmental conditions, such as high and low temperature extremes, wet and/or corrosive conditions, and the like. In such embodiments, the protrusion of set screw 451/453 may be set so that a certain amount of force must be applied to compress the set screw before a coupling mechanism may be operated to secure two components. The opposing force provided by one or more set screws 451/453 of tensioning system 450 may provide tension between the coupled components at the coupling mechanism.

In various embodiments, set screw 451/453 may be a material that is plastically deformable or non-deformable (i.e., rigid). For example, set screw 451/453 may be a metal, metal alloy, hard thermosetting plastic, and the like. In such embodiments, the protrusion of set screw 451/453 may be set so that the set screw provides a positive stop for mating of a second component to the component in which the set screw is threadedly or otherwise engaged, at a point at which a coupling mechanism may be engaged to optimally secure the two components while minimizing free movement between the components that may be permitted by the tolerances of the coupling mechanism in the absence of the tensioning system.

In with various embodiments, set screw 451/453 may be configured to be turned or adjusted with a tool. For example, set screw 451/453 may comprise a socket configured to receive a Phillips screwdriver, a flat head screwdriver, a hex head wrench, a torx wrench, or the like.

In various embodiments, set screws with configurations other than those described above may be used. For example, a set screw having a protruding end with a frustoconical configuration may be used in a tensioning device and system of a first firearm component in accordance with various embodiments, and the frustoconical protruding end may be configured to be received within a corresponding relief machined into a coupleable second firearm component. In such an embodiment, a tensioning device and/or system may provide further lateral and axial stability in the assembled firearm, in addition to providing tension in the coupling mechanism in a vertical direction. Such set screws may comprise parallel surfaces and be adjustable with a cone wrench, for example. Other configurations of tensioning devices and attachment mechanisms ware within the scope of tensioning devices and systems of the present disclosure.

In various embodiments and with reference to FIGS. 5A-5I, gas block 560 may be coupled to the barrel of a firearm, such as an auto-loading rifle of the AR10, AR15 or M16 type (e.g., firearm 100 as described and depicted herein). Gas block 560 can be coupled to the barrel of the firearm though temporary, semi-permanent, and/or permanent means. In such embodiments, the barrel of the firearm is slid through barrel bore 519 of gas block 560, and gas block 560 is coupled to firearm barrel at a desired position along the barrel. For example, gas block 560 can comprise one or more screws, pins, or detents that align with corresponding dimples or holes in the barrel, allowing the gas block to be removed from the barrel. In other embodiments, gas block 560 can be welded, soldered, brazed, or otherwise permanently attached to the barrel of the firearm. Any manner of coupling gas block 560 with the barrel of a firearm is within the scope of the present disclosure.

In various embodiments, gas block 560 may be as part of a gas piston and/or gas impingement operating system. In such embodiments, gas block 560 may comprise a body 562 defining a gas port 564 that interfaces with the barrel to allow for gas to be directed through body 562 and through the gas tube.

Figure 5C:
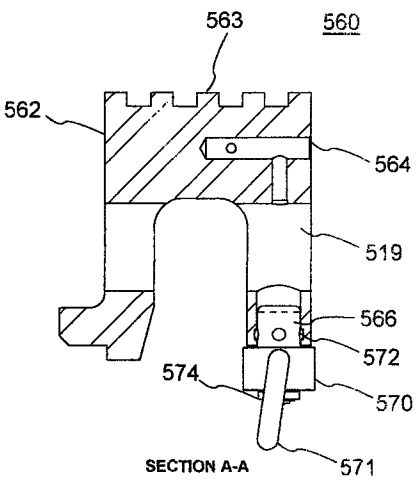
FIGS. 5A-5C are a side view, a front view, and a cross-sectional view, respectively, of a firearm sling attachment system in a first position, in accordance with the various embodiments.
Figure 5B:
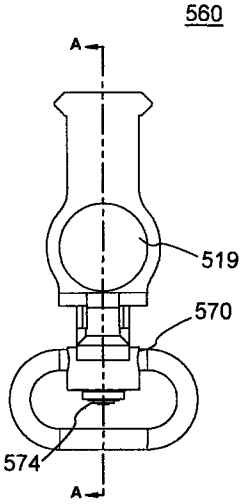
Figure 5A:
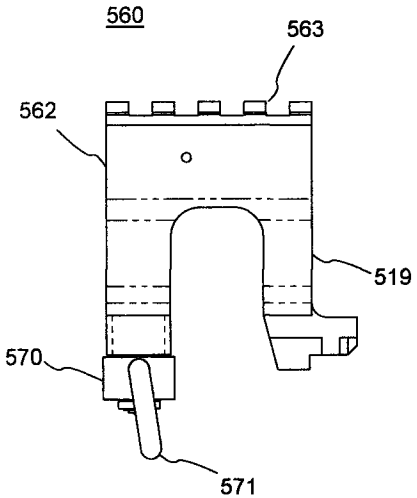
Figure 5F:
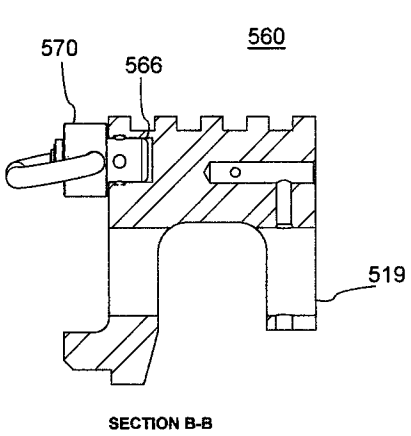
FIGS. 5D-5F are a side view, a front view, and a cross-sectional view, respectively, of a firearm sling attachment system in a second position, in accordance with the various embodiments.
Figure 5E:
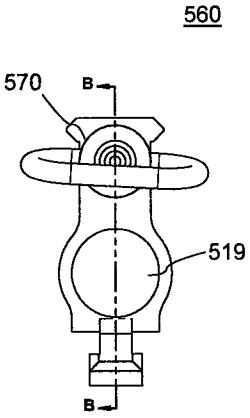
Figure 5D:
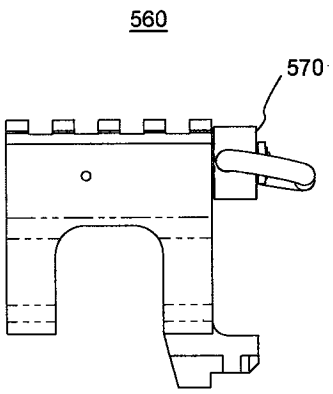
Figure 5I:
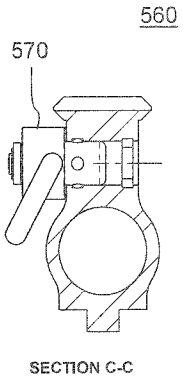
FIGS. 5G-5I are a side view, a front view, and a cross-sectional view, respectively, of a firearm sling attachment system in a third position, in accordance with the various embodiments.
Figure 5H:
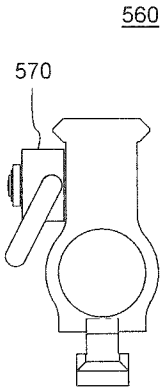
Figure 5G:
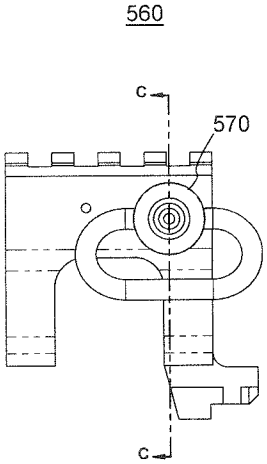

In various embodiments, gas block 560 may be configured to receive and/or may include a sling attachment 570. Sling attachment 570 may comprise a ring 571 configured to be coupled to a sling or strap as desired. In various embodiments, ring 571 is a swivel-type ring, and can be rotated up to 360 degrees. In other embodiments, ring 571 is a fixed-type ring, and maintains its angular position relative to gas block 560 and/or the firearm barrel. As illustrated in FIGS. 5A-5C, sling attachment 570 can be located below barrel bore 519 of gas block 560, and consequently, below the firearm barrel.

In various embodiments, sling attachment 570 may comprise a sling pin 572 configured to engage with a sling pin bore 566 in body 562 of gas block 560. In such embodiments, sling pin 572 can be spring loaded to engage with and remain secured within sling pin bore 566.

Sling attachment 570 may comprise, for example, a release mechanism 574. Release mechanism 574 can comprise a quick-release style mechanism coupled to sling pin 572 that allows for removal of sling attachment 570 from gas block 560 without the removal of gas block 560 from the firearm barrel.

In various embodiments, release mechanism 574 may comprise a button that, when pushed inward, allows sling pin 572 to be removed from sling pin bore 566. Release mechanism 574 can also comprise a lever or pull that, when pulled outward, allows sling pin 572 to be removed from sling pin bore 566. Any type of release mechanism 574 that facilitates the engagement and disengagement of sling pin 572 with sling pin bore 566 is within the scope of the present disclosure.

In various embodiments, gas block 560 may further comprises a rail section 563. For example, rail section 563 can comprise a segment of Picatinny rail (MIL-1913). In such embodiments, rail section 563 can be configured to allow for the attachment of other accessories, such as optical sights or projection systems. However, the use of any type of rail section 563 is within the scope of the present disclosure.

In various embodiments, sling pin bore 566 may be located at any suitable point on gas block 560. Sling attachment 570 may be removably installable within gas block 560. As illustrated in FIGS. 5A-5C, sling attachment 570 can be located below barrel bore 519 of gas block 560, and consequently, below the firearm barrel. Sling pin bore 566 may also be oriented parallel to barrel bore 519. In such embodiments, sling attachment 570 may be positioned towards the front of the firearm barrel. Sling pin bore 566 may be oriented perpendicular to and below barrel bore 519. In such embodiments, sling attachment 570 may be positioned towards the bottom of the firearm barrel.

Although described in connection with numerous examples, any position of a sling pin bore, in relation to a barrel bore is within the scope of the present disclosure. This includes any combination of more than one relative position of sling attachment and barrel bore.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A firearm gas block assembly comprising:
   - a gas block body having a gas port, a barrel bore, and a sling pin bore disposed in the gas block body; and
   - a sling attachment comprising a sling pin removably engaged with, and disposed in, the sling pin bore, wherein the sling pin is spring loaded to engage with and remain secured within the sling pin bore,
   - wherein the sling attachment further comprises a release mechanism, which facilitates engagement and disengagement of the sling pin with the sling bore, wherein the release mechanism comprises at least one of a button or a pull, wherein, when the release mechanism is the button and the button is pushed inward, or when the release mechanism is the pull and the pull is pulled outward, the sling pin is allowed to be removed from the pin bore.

2. The gas block assembly of claim 1, wherein the sling attachment further comprises a ring, wherein the ring is one of a swivel ring being rotatable up to 360 degrees and a fixed ring maintaining an angular position relative to the gas block body.

3. The gas block assembly of claim 1, wherein the release mechanism is disposed within an area enclosed by a ring.

4. The gas block assembly of claim 1, wherein the sling bore is parallel to the barrel bore.

5. The gas block assembly of claim 4, wherein the sling bore is disposed toward a front of the gas block.

6. An upper receiver, comprising:
   - a barrel; and
   - a gas block assembly, comprising:
     - a gas block body having a gas port, a barrel bore, and a sling pin bore disposed in the gas block body, wherein the gas block body is coupled to the barrel by the barrel being disposed through the barrel bore; and
     - a sling attachment comprising a sling pin removably engaged with, and disposed in, the sling pin bore, wherein the sling pin is spring loaded to engage with and remain secured within the sling pin bore,
     - wherein the sling attachment further comprises a release mechanism, which facilitates engagement and disengagement of the sling pin with the sling bore, wherein the release mechanism comprises at least one of a button or a pull, wherein, when the release mechanism is the button and the button is pushed inward, or when the release mechanism is the pull and the pull is pulled outward, the sling pin is allowed to be removed from the pin bore.

7. The upper receiver of claim 6, wherein the release mechanism is disposed within an area enclosed by a ring.

8. The upper receiver of claim 6, wherein the sling bore is parallel to the barrel bore.

9. The upper receiver of claim 8, wherein the sling bore is disposed toward a front of the gas block.

* * * * *